US008688024B2

(12) United States Patent
Hayashi et al.

(10) Patent No.: US 8,688,024 B2
(45) Date of Patent: Apr. 1, 2014

(54) CLEANING DEVICE HAVING MAGNETIC BRUSH ROLLER AND IMAGE FORMING APPARATUS PROVIDED THEREWITH

(75) Inventors: Kouichi Hayashi, Osaka (JP); Shigeki Tsukahara, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 590 days.

(21) Appl. No.: 12/913,108

(22) Filed: Oct. 27, 2010

(65) Prior Publication Data

US 2011/0110693 A1 May 12, 2011

(30) Foreign Application Priority Data

Nov. 6, 2009 (JP) ..... 2009-254513

(51) Int. Cl.
*G03G 21/00* (2006.01)
*G03G 15/00* (2006.01)

(52) U.S. Cl.
USPC ..... 399/356; 399/71; 399/349

(58) Field of Classification Search
USPC ..... 399/71, 127, 129, 148, 149, 249, 256, 399/349, 356
See application file for complete search history.

(56) References Cited

FOREIGN PATENT DOCUMENTS

| | | | | |
|---|---|---|---|---|
| JP | 01284888 | A | * | 11/1989 |
| JP | 06266266 | A | * | 9/1994 |
| JP | 09062161 | A | * | 3/1997 |
| JP | 10-143039 | | | 5/1998 |
| JP | 11-237820 | | | 8/1999 |
| JP | 2002-214870 | | | 7/2002 |
| JP | 2003098931 | A | * | 4/2003 |

* cited by examiner

*Primary Examiner* — Walter L Lindsay, Jr.
*Assistant Examiner* — Milton Gonzalez
(74) *Attorney, Agent, or Firm* — Smith, Gambrell & Russell, LLP

(57) ABSTRACT

A cleaning device of an image forming apparatus includes: a magnetic brush roller rubbing a surface of a photosensitive drum by a magnetic brush formed of a toner and carriers; a cleaning blade removing the toner remaining on a photosensitive drum; a toner concentration initialization control part, in order that toner-to-carrier ratio T/C of the magnetic brush formed on the magnetic brush roller falls within a predetermined range, controlling bias applied to the magnetic brush roller and an amount of the toner supplied from a developing device to the photosensitive drum.

7 Claims, 7 Drawing Sheets

CLEANING DEVICE HAVING MAGNETIC BRUSH ROLLER AND IMAGE FORMING APPARATUS PROVIDED THEREWITH

This application is based on Japanese Patent Applications No. 2009-254513 filed on Nov. 6, 2009, the contents of which are hereby incorporated by reference.

BACKGROUND OF THE INVENTION

1. Field of the Invention

The present invention relates to a cleaning device including a cleaning blade removing a toner on an image carrier and a magnetic brush roller removing an adhesive substance on the image carrier by a magnetic brush formed of carriers (magnetic particles) and a toner, and also to an image forming apparatus, such as a copier or a printer, provided therewith.

2. Description of Related Art

In an image forming apparatus such as a copier or a printer, a photosensitive drum whose surface is uniformly charged by a charging device is subjected to exposure scanning by an optical scanner, and an electrostatic latent image is formed on the surface thereof in accordance with image information. Then the electrostatic latent image is developed by a developing device by using a toner as a developer to be visualized as a toner image. This toner image is transferred onto paper from the photosensitive drum by a transfer device and then heated and pressurized to be fixed onto the paper by a fixing device, and the paper with the toner image fixed thereon is discharged out of the apparatus, thereby ending a series of image formation operation. The toner remaining on the photosensitive drum without being transferred onto the paper in the transfer process (post-transfer remaining toner) is removed by a cleaning device for collection.

In a process of discharging by the charging device in the image forming apparatus, an ion product such as $NO_x$, $SO_x$, or the like is generated, and this ion product adheres to the surface of the photosensitive drum. Moreover, in an image forming apparatus that applies configuration such that recording paper is conveyed while in contact with the photosensitive drum, an additive agent, paper dust, etc. included in the recording paper adhere to the surface of the photosensitive drum.

Upon the adhesion of the additive agent, the paper dust, etc. to the surface of the photosensitive drum, these adhesive substances absorb moisture to reduce surface potential of the photosensitive drum, and thus charges generated on the surface of the photosensitive drum by the charging device easily move along the surface of the photosensitive drum, causing a phenomenon of image deletion, which deteriorates image quality.

Thus, provided in the cleaning device is a polishing roller formed of an elastic body such as foamed synthetic rubber as means adapted to remove the ion product, the additive agent, the paper dust, etc. adhering to the surface of the photosensitive drum. Rotating this polishing roller while bringing it into contact with the photosensitive drum polishes the surface of the photosensitive drum, and shaving off the adhesive substances cleans the surface of the photosensitive drum, thereby preventing occurrence of the image deletion, etc. as a result of the absorption of the adhesive substances.

However, use of the polishing roller as means adapted to remove the adhesive substances may excessively polish the surface of the photosensitive drum by the polishing roller, causing a problem that life of the photosensitive drum shortens in such a case. In recent circumstance where there are demands for apparatus development that achieves longer life and higher productivity, demands for maintaining stable polishing capability throughout the life have been placed on the photosensitive drum. However, it is difficult to maintain the stable polishing capability due to bending or deformation of the polishing roller.

Moreover, carried out as another countermeasure has been a method of disposing a drum heater near the photosensitive drum and vaporizing moisture absorbed by the adhesive substances through heating by this drum heater to prevent the occurrence of the image deterioration caused by the absorption of the adhesive substances. However, there is a problem that the drum heater is expensive and has high power consumption.

Suggested to solve the problem described above is configuration such that a two-component developer composed of a toner and carriers (magnetic particles) is used as a developer and a rotatable magnetic brush roller is provided in the cleaning device to remove the adhesive substances by polishing the surface of the photosensitive drum by the magnetic brush formed on a surface of the magnetic brush roller. With this configuration, the magnetic brush roller itself does not make contact with the photosensitive drum, and a gap is formed therebetween, and thus the stable polishing capability is maintained without causing uneven polishing regardless of, for example, the bending or deformation of the magnetic brush roller.

However, in the method described above, a small diameter of the photosensitive drum results in a small nip width for the polishing by the magnetic brush, thus causing a problem that a force of polishing the photosensitive drum weakens.

In the method described above, with configuration such that bias with DC bias superposed on AC bias is applied to the magnetic brush roller, reciprocating movement of the developer occurs in a gap between the surface of the photosensitive drum and a surface of a sleeve of the magnetic brush roller, a force in which the developer beats the surface of the photosensitive drum by an electric field increases, and the carriers rub the surface of the photosensitive drum, thus improving capability of removing an impure substance adhering to the surface of the photosensitive drum.

However, in a case where only the carriers as the magnetic brush rub the surface of the photosensitive drum, effect of its rubbing is low. On the contrary, in a state in which the toner adhere to the carriers, the magnetic brush is formed densely on the magnetic brush roller with the toner lying between the carriers, thus improving a force of the magnetic brush pressure-contacting the surface of the photosensitive drum and improving the effect of rubbing the surface of the photosensitive drum by the magnetic brush.

Moreover, in a case where the bias is applied to the magnetic brush roller, toner movement to the photosensitive drum occurs, thus reducing an amount of toner on the magnetic brush formed on the magnetic brush roller and deteriorating the effect of rubbing the surface of the photosensitive drum by the magnetic brush. Thus, the toner needs to be fed to a rubbed portion of the photosensitive drum as needed to stabilize toner-to-carrier ratio (toner weight/carrier weight: hereinafter referred to as T/C) on the magnetic brush. High T/C on the magnetic brush roller results in a large amount of toner held by the magnetic brush, degrading mobility of the magnetic brush, which therefore improves the capability of rubbing the photosensitive drum. However, an excessive increase in the T/C further degrades the mobility of the magnetic brush, thus leading to an increase in the driving torque of the photosensitive drum, which may cause image failure such as a jitter image attributable to ununiform rotation of the photosensitive drum.

On the contrary, low T/C on the magnetic brush roller results in an improvement in the mobility of the magnetic brush, thus not causing the increase in the driving torque of the photosensitive drum as described above. However, the capability of rubbing the surface of the photosensitive drum by the magnetic brush deteriorates, resulting in failure to effectively remove the adhesive substances from the surface of the photosensitive drum.

Thus, the T/C of the magnetic brush formed on the magnetic brush roller needs to be appropriately controlled. However, an amount of the post-transfer toner remaining on the surface of the photosensitive drum after the transfer varies depending on environment, toner chargeability, etc., thus actually making it difficult to control the T/C of the magnetic brush taking the amount of the post-transfer toner into consideration.

SUMMARY OF THE INVENTION

It is an object of the present invention to provide a cleaning device capable of maintaining high effect of rubbing a surface of even a photosensitive drum of a small diameter over a long period of time and an image forming apparatus capable of preventing occurrence of image failure to stably provide a high-quality image.

To achieve the object described above, a cleaning device of an image forming apparatus according to one aspect of the invention includes: a magnetic brush roller rubbing a surface of a photosensitive drum by a magnetic brush formed of a toner and carriers; a cleaning blade removing the toner remaining on the photosensitive drum; and a toner concentration initialization control part, in order that toner-to-carrier ratio T/C of the magnetic brush formed on the magnetic brush roller falls within a predetermined range, controlling bias applied to the magnetic brush roller and an amount of the toner supplied from a developing part to the photosensitive drum.

With this aspect, in order that the toner-to-carrier ratio T/C of the magnetic brush formed on the magnetic brush roller falls within an adequate value, the bias applied to the magnetic brush roller is controlled, and also the amount of the toner supplied from the developing part to the photosensitive drum is controlled, thus also controlling an amount of the toner supplied from the photosensitive drum to the magnetic brush roller. Consequently, the toner-to-carrier ratio T/C of the magnetic brush formed on the magnetic brush roller can be kept at the adequate value, and even with a photosensitive drum of a small diameter, high effect of rubbing a surface thereof can be maintained over a long period of time, and an adhesive substance can effectively be removed from the surface of the photosensitive drum.

Other features and advantages of the invention will be more clarified by embodiments described below.

DETAILED DESCRIPTION OF PREFERRED EMBODIMENTS

Hereinafter, embodiments of the present invention will be described with reference to the accompanying drawings.

[Image Forming Apparatus]

Figure 1:
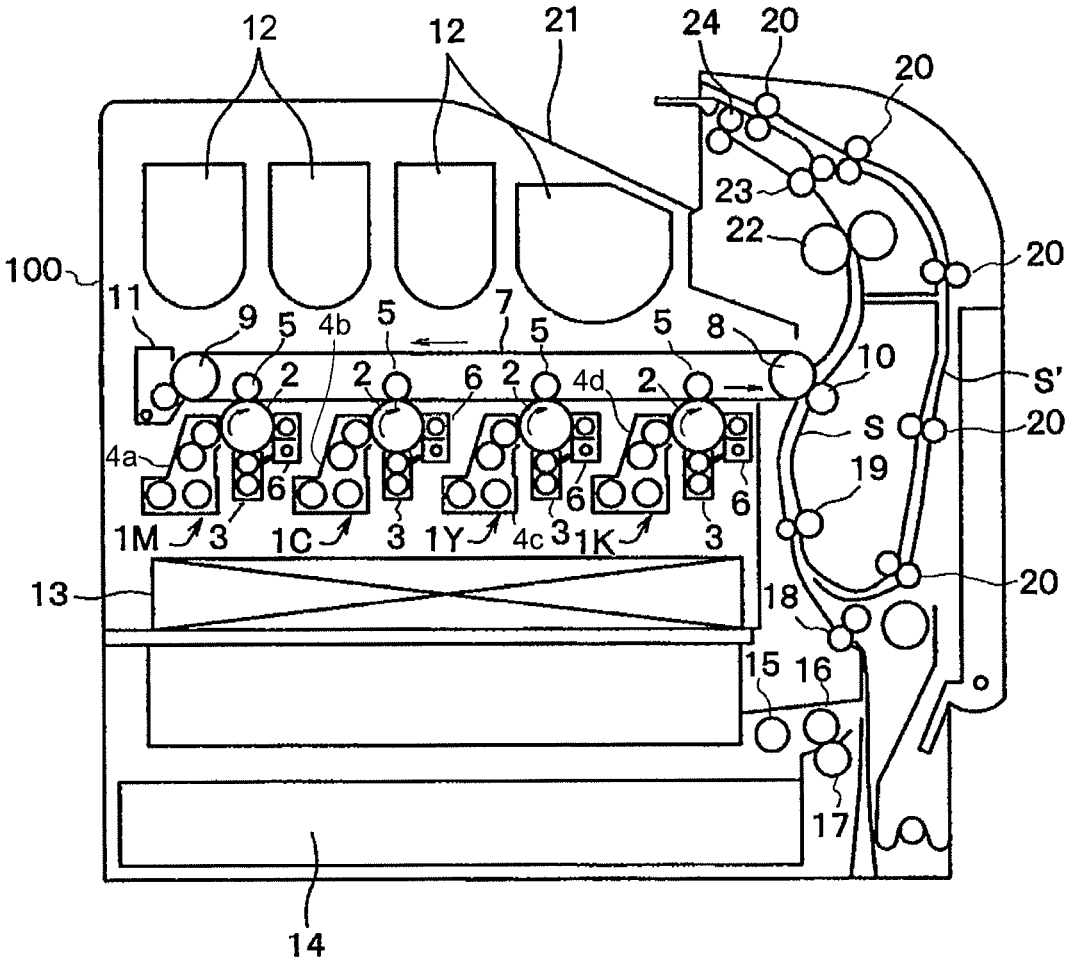
FIG. 1 is a sectional side view of an image forming apparatus (color laser printer) according to the present invention.

FIG. 1 is a sectional side view of a color laser printer as one embodiment of an image forming apparatus according to the invention. The color laser printer shown is of a tandem type, having at a central part of a main body 100 thereof a magenta image forming unit 1M, a cyan image forming unit 1C, an yellow image forming unit 1Y, and a black image forming unit 1K arranged tandemly at regular intervals.

Respectively arranged in the image forming units 1M, 1C, 1Y, and 1K are photosensitive drums 2 as image carriers. Arranged around each of the photosensitive drums 2 are: a charging roller 3, a developing device 4, a transfer roller 5, and a cleaning device 6 according to the invention.

Here, the photosensitive drum 2 is a drum-type photosensitive drum and driven by a driving motor (not shown) into rotation in a direction of arrow in the figure (a clockwise direction) at a predetermined process speed. The charging roller 3 uniformly changes a surface of the photosensitive drum 2 to predetermined potential by charging bias applied from a charging bias power source (not shown).

The developing devices 4*a* to 4*d* respectively store two-component developers composed of magenta, cyan, yellow, and black toners, respectively and carriers (magnetic particles). The toners of the respective colors are attached to respective electrostatic latent images formed on the respective photosensitive drums 2 to visualize the electrostatic latent images as toner images of the respective colors.

The transfer roller 5 is so arranged as to be capable of making contact with the respective photosensitive drum 2 with an intermediate transfer belt 7 therebetween in a respective primary transfer part. Here, the intermediate transfer belt 7 is so arranged as to be stretched between a driving roller 8 and a tension roller 9 and capable of traveling on a top side of the photosensitive drums 2. The driving roller 8 is so arranged as to be capable of making contact with a secondary transfer roller 10 with the intermediate transfer belt 7 therebetween in a secondary transfer part. Near the tension roller 9, a cleaning device 11 is provided.

Above the image forming units 1M, 1C, 1Y, and 1K in the printer main body 100, a toner containers 12 for refilling the respective developing devices 4 with the toners are laid in line.

Below the image forming units 1M, 1C, 1Y, and 1K in the printer main body 100, a laser scanner unit (LSU) 13 as optical scanning means is arranged. At a bottom part of the printer main body 100 therebelow, a paper feed cassette 14 is detachably set. In the paper feed cassette 14, a plurality of pieces of paper (not shown) are stored in a stacked manner. Provided near this paper feed cassette 14 are: a pickup roller 15 that takes out the pieces of paper from the paper feed cassette 14; and a feed roller 16 and a retard roller 17 that separate the pieces of paper taken out and deliver the taken-out pieces of paper individually to a conveying path S.

Provided on the conveying path S extending vertically of a side part of the printer main body 100 are: a conveying roller pair 18 that conveys the paper; and a registration roller pair 19 that temporarily keeps the paper on standby and then supplies it at predetermined timing to the secondary transfer part as a part where the secondary transfer roller 10 and the driving roller 8 opposing the secondary transfer roller 10 make contact with each other. Formed beside the conveying path S is another conveying path S' for use in a case where an image is formed on both sides of the paper. On this conveying path S', a plurality of reversing roller pairs 20 are provided at adequate intervals.

The conveying path S arranged longitudinally of one side part in the printer main body 100 extends to a paper discharge tray 21 provided on a top surface of the printer main body 100, and a fixing device 22, and paper discharge roller pairs 23 and 24 are provided in the middle of the conveying path S directed to the paper discharge tray 21.

Next, image forming operation performed by the color laser printer having the configuration described above will be described.

When an image formation start signal has been generated, the respective photosensitive drums 2 in the image forming units 1M, 1C, 1Y, and 1K are driven into rotation in the direction of arrow in the figure (clockwise direction) at the predetermined process speed, and these photosensitive drums 2 are uniformly charged by the respective charging rollers. The laser scanner unit 13 outputs light beams modulated by color image signals of the respective colors, irradiates the light beams to surfaces of the respective photosensitive drums 2, thereby forming on the respective photosensitive drums 2 the electrostatic latent images corresponding to the color image signals of the respective colors.

Then, first to the electrostatic latent image formed on the photosensitive drum 2 of the magenta image forming unit 1M, the magenta toner is attached by the developing device 4 to which developing bias with the same charging polarity as that of the photosensitive drum 2 has been applied, and this electrostatic latent image is visualized as the magenta toner image. This magenta toner image is, under the action of the transfer roller 5 to which primary transfer bias with a polarity opposite to that of the toner, primarily transferred onto the intermediate transfer belt 7 driven into rotation in the direction of arrow in the figure (counterclockwise direction) in a primary transfer part (transfer nip part) between the photosensitive drum 2 and the transfer roller 5.

The intermediate transfer belt 7 on which the magenta toner image has been primarily transferred in a manner described above moves to the next cyan image forming unit 1C. Then also in the cyan image forming unit 1C, in the same manner as described above, the cyan toner image formed on the photosensitive drum 2 is transferred in such a manner as to be superimposed on the magenta toner image on the intermediate transfer belt 7 in the primarily transfer part.

In the same manner as described above, on the magenta and cyan toner images transferred onto the intermediate transfer belt 7 in a superimposed manner, the yellow and black toner images respectively formed on the photosensitive drums 2 of the yellow and black image forming units 1Y and 1K are sequentially superimposed in respective primary transfer parts, whereby a full color toner images is formed on the intermediate transfer belt 7. The post-transfer toners remaining on the respective photosensitive drums without being transferred onto the intermediate transfer belt 7 are removed by the respective cleaning devices 6, and each of the photosensitive drums 2 is prepared for the next image formation.

Then in synchronization with timing at which a tip of the full color toner image on the intermediate transfer belt 7 reaches the secondary transfer part (transfer nip part) between the driving roller 8 and the secondary transfer roller 10, the paper delivered from the paper feed cassette 14 to the conveying path S by the pickup roller 15, the feed roller 16, and the retard roller 17 is conveyed to the secondary transfer part by the registration roller pair 19. Then onto the paper conveyed to the secondary transfer part, the full color toner image is secondarily transferred collectively from the intermediate transfer belt 7 by the secondary transfer roller 10 to which secondary transfer bias with a polarity opposite to that of the toners is applied.

The paper with the full color toner image transferred thereon is conveyed to the fixing device 22, where the full color toner image is heated and pressurized to be thermally fixed onto a surface of the paper. Then the paper with the toner image fixed thereon is discharged onto the paper discharge tray 21 by the paper discharging roller pairs 23 and 24, thereby completing a series of image formation operation. The post-transfer toner remaining on the intermediate transfer belt 7 without being transferred onto the paper is removed by the belt cleaning device 11, and the intermediate transfer belt 7 is prepared for the next image formation.

[Cleaning Device]

Next, the cleaning device 6 according to the first embodiment will be described. The cleaning devices 6 respectively provided in the image forming units 1M, 1C, 1Y, and 1K have the same configuration, and thus only one of the cleaning devices 6 will be described below.

[First Embodiment]

Figure 2:
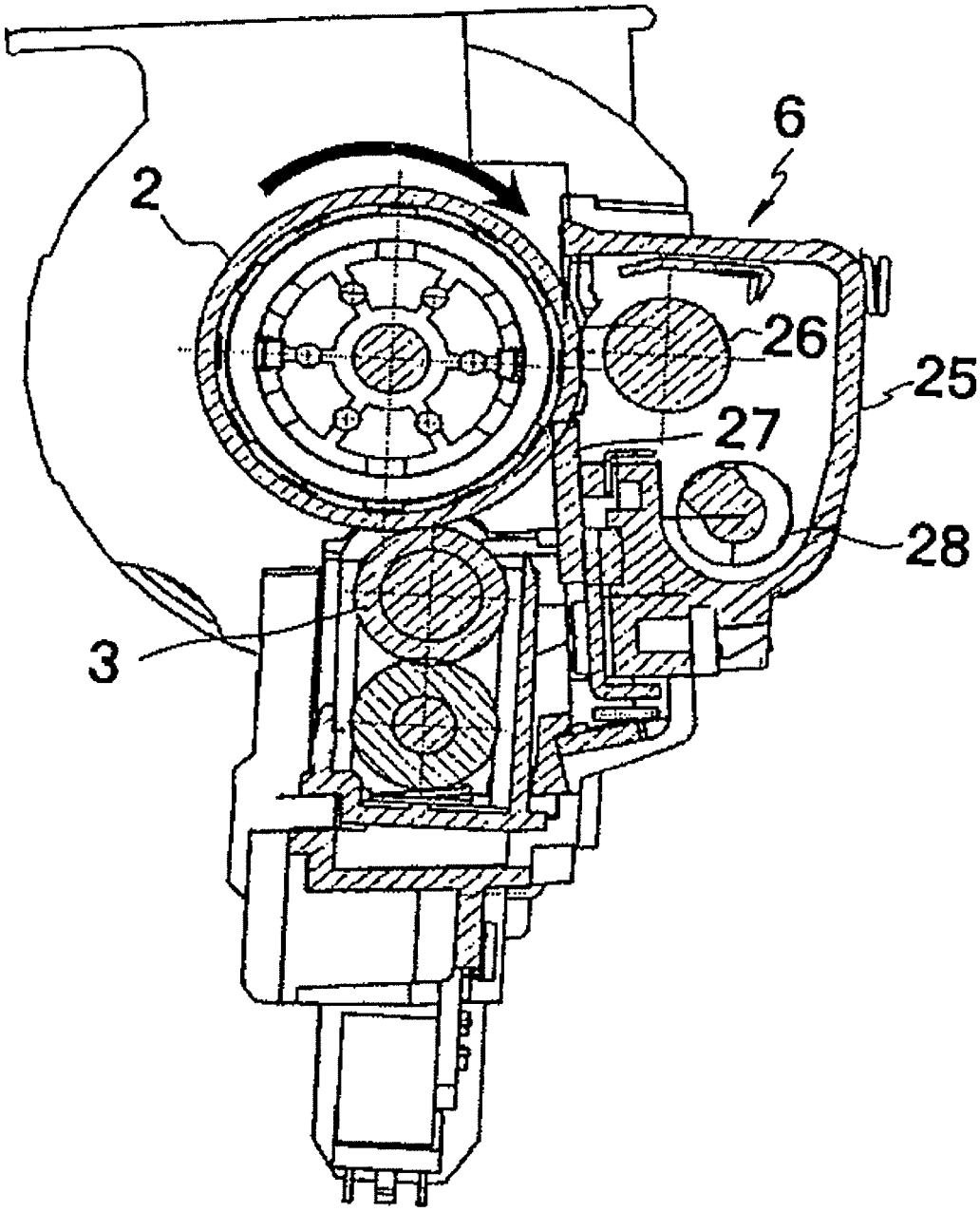
FIG. 2 is a sectional side view of a cleaning device according to a first embodiment.

FIG. 2 is a sectional side view of the cleaning device 6 according to the first embodiment. As shown in the figure, in a housing 25 of the cleaning device 6, a rotatable magnetic brush roller 26 is arranged oppositely to the photosensitive drum 2 with a predetermined gap provided therebetween. This magnetic brush roller 26 is so structured as to have a cylindrical sleeve of a nonmagnetic material such as aluminum, stainless, or the like arranged at outer circumference of a magnet roller having a plurality of magnetic poles arranged circumferentially. Formed on the sleeve is a magnetic brush so formed as to hold the tow-component developer formed of carriers and a toner. This magnetic brush formed of the carriers and the toner rubs the surface of the photosensitive drum 2.

Attached to a bottom part of an opening part of the housing 25 opposing the photosensitive drum 2 is a cleaning blade 27 for scraping the post-transfer toner remaining on the photosensitive drum 2 by making contact with the surface of the photosensitive drum 2. This cleaning blade 27 makes contact with the photosensitive drum 2 in a direction opposite to a rotational direction of the photosensitive drum 2 on a side downstream of a position where the surface of the photosensitive drum 2 opposes the magnetic brush roller 26 (downstream in the rotational direction of the photosensitive drum 2 and also at a lower part of FIG. 2).

Further stored in the housing 25 is a conveying screw 28 that is rotatable. The post-transfer toner remaining on the photosensitive drum 2 is scraped by the cleaning blade 27 from the surface of the photoconductive drum 2, conveyed axially (perpendicularly of a paper surface of FIG. 2) by the rotating conveying screw 28, and collected into a waste toner container (not shown) outside of the housing 25.

An ion product such as $NO_x$, $SO_x$, or the like generated by electric discharge of the charging roller 3 in a process of the image formation operation in the color laser printer shown in FIG. 1 adheres, but an adhesive substance such as the ion product is removed by being rubbed by the magnetic brush formed at the magnetic brush roller 26 rotating in the cleaning device 6. Moreover, the post-transfer toner remaining on the photosensitive drum 2 after the toner image is transferred onto the intermediate transfer belt 7 is removed by being rubbed by the cleaning blade 27 of the cleaning device 6, and the photosensitive drum 2 whose surface has been cleaned is prepared for the next image formation operation.

In the rubbing of the surface of the photosensitive drum 2 by the magnetic brush roller 26, if T/C on the magnetic brush roller 26 is high as described above, the magnetic brush holds a large amount of toner, which degrades mobility of the magnetic brush, thus leading to an improvement in capability of rubbing the photosensitive drum 2. However, an increase in the T/C beyond necessity further degrades the mobility of the magnetic brush, thus possibly leading to an increase in driving torque of the photosensitive drum and causing image failure such as a jitter image attributable to ununiform rotation of the photosensitive drum 2.

On the contrary, if the T/C on the magnetic brush roller 26 is low, the mobility of the magnetic brush increases, and thus an increase in the driving torque of the photosensitive drum 2 as described above does not occur. However, the capability of rubbing the surface of the photosensitive drum 2 by the magnetic brush deteriorates, resulting in failure to effectively remove the adhesive substance from the surface of the photosensitive drum 2.

Thus, to appropriately control the T/C of the magnetic brush formed on the magnetic brush roller 26, this embodiment is characterized in that a toner concentration initialization control part 30 performing toner concentration initialization control is provided.

Here, details of the control will be described with reference to FIGS. 3 and 4.

Figure 3:
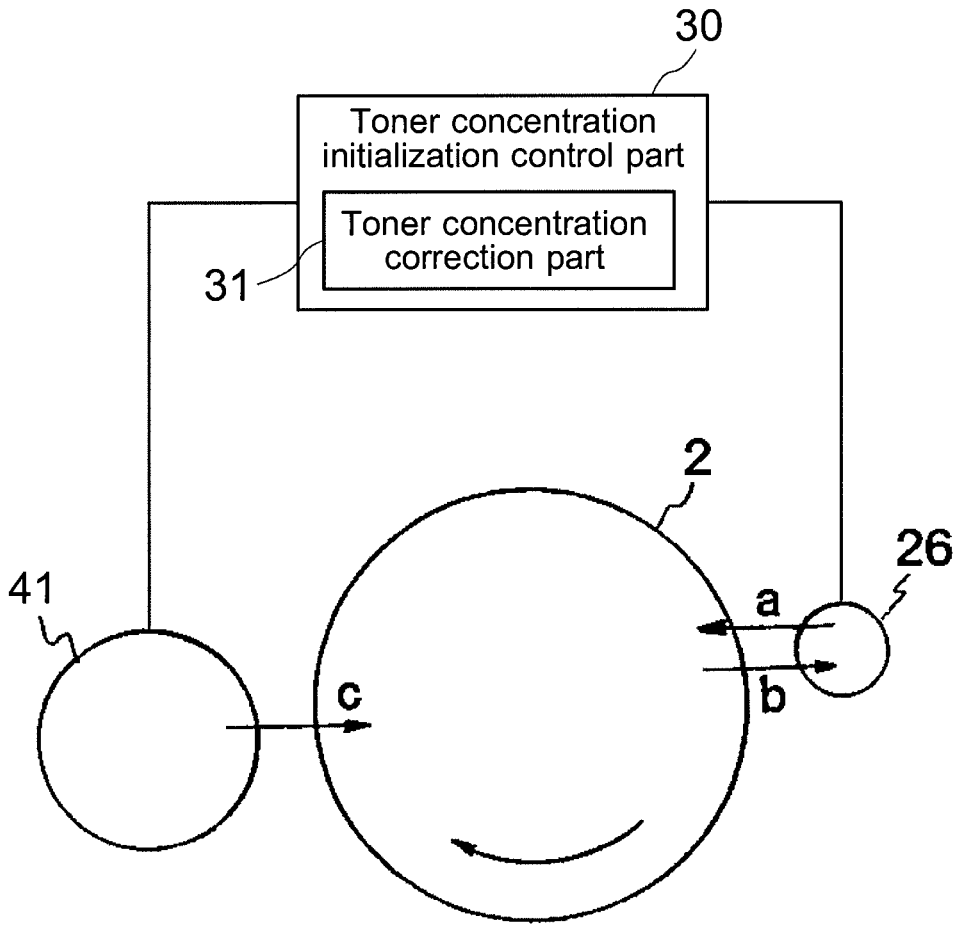
FIG. 3 is a pattern diagram illustrating toner movement (consumption and supply) between a photosensitive drum, a magnetic brush roller, and a developing roller for illustration of toner concentration initialization control carried out in the cleaning device according to the first embodiment.

FIG. 3 is a pattern diagram illustrating toner movement (consumption and supply) between the photosensitive drum, the magnetic brush, and the developing roller for illustration of the toner concentration initialization control. FIG. 4 is a time chart of applied bias in the toner concentration initialization control.

Figure 4:
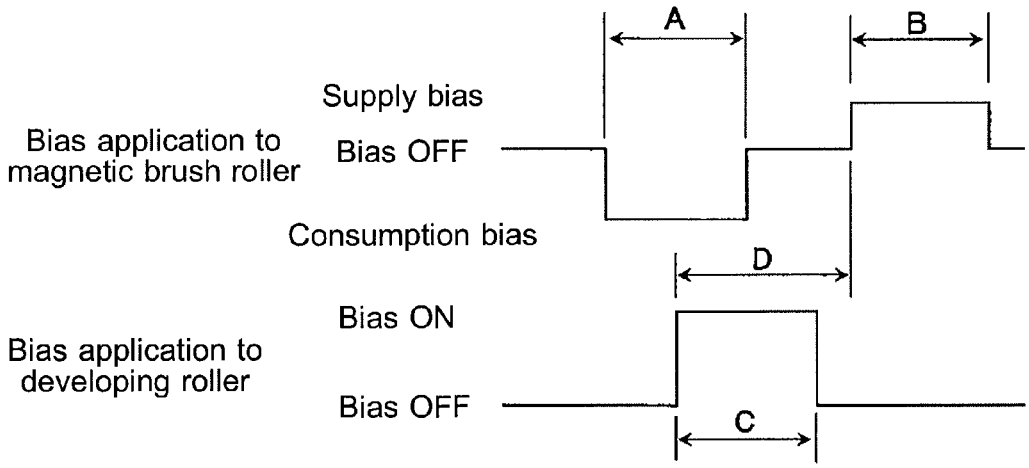
FIG. 4 is a time chart of applied bias in the toner concentration initialization control carried out in the cleaning device according to the first embodiment.

In the toner concentration initialization control, consumption bias is applied to the magnetic brush roller 26 for time A as shown in FIG. 4 to temporarily transfer onto the photosensitive drum 2 all the toner on the magnetic brush formed on the magnetic brush roller 26 (arrow "a" of FIG. 3), and then this toner is scraped and thereby removed from the surface of the photosensitive drum 2 by the cleaning blade 27. Here, the time A for which the consumption bias is applied to the magnetic brush roller 26 is time for which the magnetic brush roller 26 makes at least one rotation. By such setting, all the toner held on the magnetic brush roller 26 moves onto the photosensitive drum 2.

Next, by using a toner concentration correction part 31 for keeping the toner concentration constant, a toner amount with which the T/C of the magnetic brush on the magnetic brush roller 26 becomes an adequate value is calculated, and this calculated amount of toner is supplied from the developing device 4 onto the photosensitive drum 2 (arrow "c" of FIG. 3). Specifically, as shown in FIG. 4, developing bias is applied to a developing roller 41 of the developing device 4 for time C while the consumption bias is applied to the magnetic brush roller 26 (within the magnetic brush roller 26 completes one rotation) to thereby supply a predetermined amount of toner onto the photosensitive drum 2.

Then, as shown in FIG. 4, at timing at which the toner on the photosensitive drum 2 reaches the magnetic brush roller 26 after passage of time D since start of the toner supply from the developing device 4 onto the photosensitive drum 2, supply bias is applied to the magnetic brush for time B to thereby supply to the magnetic brush roller 26 the toner supplied onto the photosensitive drum 2 from the developing device 4 (arrow "b" of FIG. 3).

In the toner concentration initialization control described above, all the toner on the magnetic brush formed on the magnetic brush roller 26 is temporarily removed and transferred onto the photosensitive drum 2, then is supplied from the developing device 4 to the photosensitive drum 2 so that the toner-to-carrier ratio T/C of the magnetic brush on the magnetic brush roller 26 becomes the adequate value, and the toner supplied to the photosensitive drum 2 is supplied to the magnetic brush roller 26. Consequently, the toner-to-carrier ratio T/C of the magnetic brush on the magnetic brush roller 26 can be kept at the adequate value, high effect of rubbing the surface of even a photosensitive drum 2 with a small diameter can be maintained over a long period of time, and the adhesive substance can effectively be removed from the surface of the photosensitive drum 2.

Moreover, the increase in the driving torque of the photosensitive drum 2 can be suppressed, preventing the ununiform rotation of this photosensitive drum 2, thereby preventing the occurrence of the image failure such as the jitter image attributable to the ununiform rotation to stably provide a high-quality image.

The toner concentration initialization control is performed at times other than time of image formation so as not to influence normal image formation operation. Moreover, the toner concentration initialization control is performed with frequency in accordance with image condition and environment. Especially in high temperature/high humidity environment (H/H environment), for example, 32.5 degrees Celsius/80%, where a problem such as image deletion as a result of absorption of the adhesive substance to the photosensitive drum 2 is likely to occur, the frequency with which the toner concentration initialization control is performed increases. Consequently, rubbing performance on the surface of the photosensitive drum 2 by the magnetic brush roller 26 can be increased, effectively preventing the occurrence of the image failure.

Next, Example of the invention will be described.

EXAMPLE

Main components of the device used are as follow.

—Developing Device:

Developing roller circumferential speed: 480 mm/sec,

Developing bias: AC 1.5 kV, DC +20V, frequency 4.0 kHz (rectangular wave),

Toner: pulverized color positively charged toner (particle size: 6.8 μm),

Carrier: ferrite carrier (particle size: 45 μm), and

T/C: 12%

—Photosensitive Drum: a-Si Drum (Outer Diameter: (ϕ30 Mm),

Surface potential: +300V, potential after exposure: +20V,

Circumferential speed 300 mm/sec.

—Charging Roller: Outer Diameter: ϕ12 Mm, Shaft Diameter: ϕ8 Mm,

Material: epichrolohydrin rubber,

Applied voltage: AC 1.2 kV, DC +450V, frequency 2.0 kHz (sinusoidal wave).

—Magnetic Brush Roller: Outer Diameter: ϕ12 mm, NS Alternate Four Poles (S Pole on a Side Closest to the Drum), Magnetic force: 200 to 500 G Sleeve circumferential speed: 384 mm/sec, Gap between photosensitive drums: 300 μm, Magnetic brush amount: 12 g, Used carrier is the same as the carrier used for development, Applied voltage: AC 1.5V, DC +200V, Frequency 4.0 kHz (Sinusoidal wave), (Normal) Applied voltage: AC 1.5 kV, DC +20V, frequency 4.0 kHz (Sinusoidal wave), (Toner concentration initialization control: Consumption) Applied voltage: AC 1.5 kV, DC +100V, frequency 2.0 kHz (Sinusoidal wave), (Toner concentration initialization control: Supply) Applied voltage: AC 1.5 kV, DC −100V, frequency 2.0 kHz (Sinusoidal wave).

—Intermediate Transfer Belt: Circumferential Speed 320 mm/Sec.

It has been checked whether or not the jitter and the image deletion occur when the toner concentration initialization control is performed in component condition described above so that the T/C of the magnetic brush on the magnetic brush roller 26 becomes 8, 10, 12, 15, 17, or 18%. Table 1 shows results of this checking. In Table 1, ○ indicates "no occurrence has been identified with judging eyes", × indicates "the occurrence has been identified", and even the occurrence partially identified is identified as ×. Moreover, the toner concentration initialization control was performed: every 500 pieces in normal environment; and at time of startup and also every 100 pieces in the H/H environment (32.5 degrees Celsius/80%). Here, the "image deletion" is a phenomenon that the image blurs due to disturbance of the electrostatic latent image as a result of adhesion of a discharge product, paper dust, an ingredient of the paper, etc. to the surface of the photosensitive drum. Moreover, the "jitter image" is a phenomenon that a shading difference (line) occurs in the image at the time of image formation and transfer due to torque variation (phenomenon that the shading difference occurs with a gear tooth pitch, mainly due to driving transmission (gear tooth)).

TABLE 1

| T/C[%] | Jitter image | Image deletion |
|---|---|---|
| 8 | ○ | x |
| 10 | ○ | ○ |
| 12 | ○ | ○ |
| 15 | ○ | ○ |
| 17 | ○ | ○ |
| 18 | x | ○ |

Results of Table 1 proves that the T/C of the magnetic brush on the magnetic brush roller 26 should be adjusted to 10 to 17%.

<Second Embodiment>

Next, a cleaning device according to the second embodiment will be described.

Configuration of the cleaning device according to the second embodiment is the same as that of the cleaning device 6 according to the first embodiment shown in FIG. 2, and thus its illustration and description will be omitted. In the description below, numerals used in FIG. 2 are used. Moreover, main components used in the device are also the same as those of the first embodiment.

The cleaning device 6 according to the second embodiment is characterized by performing T/C control of keeping the toner-to-carrier ratio T/C of a magnetic brush on a magnetic brush roller 26 constant by detecting a current flowing into the magnetic brush roller 26 upon bias application to the magnetic brush roller 26, supplying a toner to the magnetic brush roller 26 from a developing device 4 via a photosensitive drum 2 when the detected current is equal to or larger than a first threshold value (7 μA in this embodiment), and discharging the toner from the magnetic brush roller 26 to the photosensitive drum 2 when the detected current is smaller than a second threshold value (5 μA in this embodiment) that is smaller than the first threshold value (7 μA).

Figure 5:
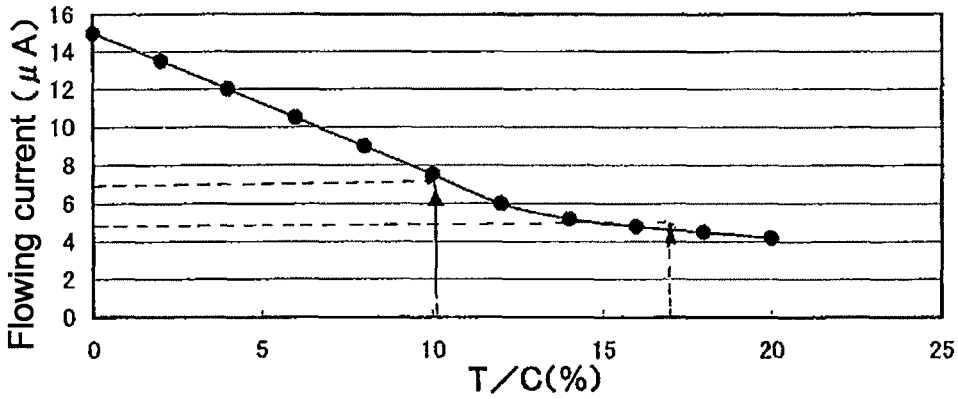
FIG. 5 is a diagram showing relationship between T/C of a magnetic brush and a current flowing into the magnetic brush roller.

Here, relationship between the current (μA) flowing into the magnetic brush roller 26 upon the bias application to the magnetic brush roller 26 and the T/C (%) of the magnetic brush is as shown in FIG. 5. Therefore, it is proved that the T/C of the magnetic brush can be controlled by detecting the current flowing into the magnetic brush roller 26.

Figure 6:
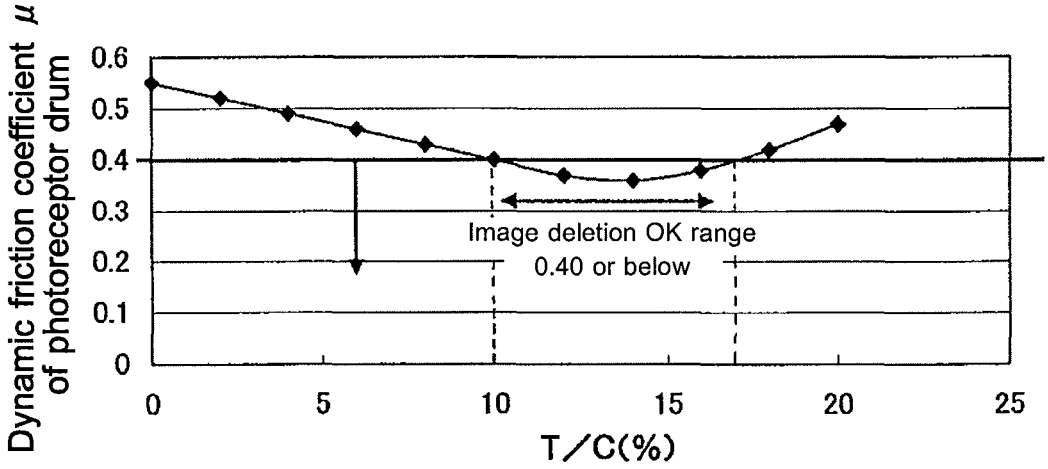
FIG. 6 is a diagram showing relationship between the T/C of the magnetic brush and a dynamic friction coefficient of the photosensitive drum.

When a dynamic friction coefficient μ of the photosensitive drum 2 is used as a parameter indicating a cleaning state of the surface of the photosensitive drum 2, relationship as shown in FIG. 6 exists between this dynamic friction coefficient μ and the T/C of the magnetic brush, and it is proved that condition for avoiding the occurrence of the image deletion is that the dynamic friction coefficient μ needs to be controlled at 0.4 or below.

Therefore, FIGS. 5 and 6 prove that preventing the occurrence of the image deletion requires controlling the T/C of the magnetic brush in a range of 10 to 17%, that is, controlling the current flowing into the magnetic brush roller 26 at a range of 5 to 7 μA.

Based on the above, in a case where 7 μA or above has been detected as the current flowing into the magnetic brush roller 26, the T/C of the magnetic brush needs to be increased and thus the toner needs to be supplied from the developing device 4 to the magnetic brush roller 26. Specifically, the toner is moved to the photosensitive drum 2 by applying developing bias to a developing roller 41 of the developing device 4 in a state that charge potential is not put on the surface of the photosensitive drum 2, and the toner on this photosensitive drum 2 is supplied to the magnetic brush roller 26.

On the other hand, in a case where 5 μA or below has been detected as the current flowing into the magnetic brush roller 26, the T/C of the magnetic brush needs to be decreased, and thus the toner needs to be torn off from the carriers of the magnetic brush through bias application to the magnetic brush roller 26, and then this torn-off toner needs to be redeveloped on the photosensitive drum 2 and then scraped and discharged from the photosensitive drum 2 by a cleaning blade 27.

The T/C control described above is performed at the times other than the time of image formation so as not to influence the normal image formation operation. Alternatively, the T/C control is performed with frequency in accordance with image condition and environment. Especially in the high temperature/high humidity environment (H/H environment), for example, in 32.5 degrees Celsius/80%, where the problem such as the image deletion as a result of the absorption of the adhesive substance to the photosensitive drum 2 is likely to occur, increasing the frequency with which the T/C control is performed can improve rubbing performance on the surface of the photosensitive drum 2 by the magnetic brush roller 26, effectively preventing the occurrence of the image failure.

Figure 7:
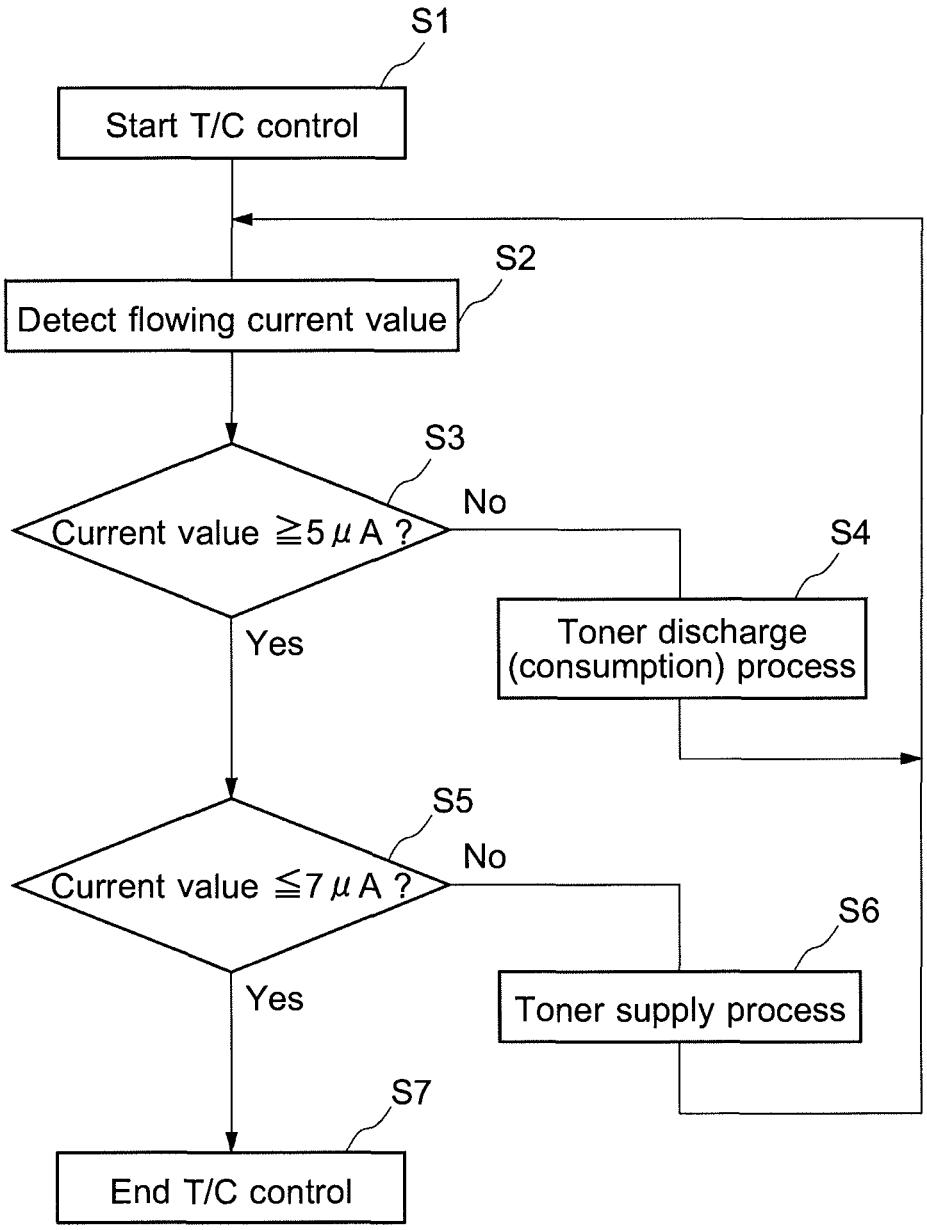
FIG. 7 is a flowchart showing procedures of T/C control carried out in a cleaning device according to a second embodiment.

Next, procedures of the T/C control described above will be described with reference to a flowchart shown in FIG. 7.

When the T/C control has been started (step S1), the current flowing into the magnetic brush roller 26 is detected (step S2), and it is determined whether or not a value of this current is 5 μA or above (step S3). If the current value is less than 5 μA (if a determination result in step S3 is No), the T/C of the magnetic brush needs to be decreased and thus a discharge (consumption) process of applying the bias to the magnetic brush roller 26 to discharge the toner on the magnetic brush roller 26 is performed (step S4). Then this discharge (consumption) process is repeated until the current value becomes 5 μA or above (steps S2 to 4).

If the current value is 5 μA or above (if the determination result in step S3 is Yes), it is determined whether or not the current value is 7 μA or below (step S5). If the current value is over 7 μA (a determination result in step S5 is No), the T/C of the magnetic brush needs to be increased and thus a toner supply process of supplying the toner from the developing device 4 to the magnetic brush roller 26 is performed (step S6). Then the toner supply process is repeated until the current value becomes 5 μA or above (steps S2 to 6). Then when the current value falls within a range of 5 μA to 7 μA, the T/C control ends (step S7).

As described above, in the invention, the T/C control is performed by supplying or discharging the toner to or from the magnetic brush roller 26 by the current flowing into the magnetic brush roller 26 upon the bias application to the magnetic brush roller 26, so that the T/C becomes a value (10 to 17%) with which the dynamic friction coefficient of the photosensitive drum 2 is kept in a range equal to or less than a value (0.4) with which the image deletion does not occur. Consequently, even with a photoconductive drum 2 of a small diameter, the image failure such as the image deletion can be prevented and also the high effect of rubbing the surface of the photosensitive drum 2 can be maintained over the long period of time, providing effect that the adhesive substance can effectively be removed from the surface of the photosensitive drum 2.

Here, the dynamic friction coefficient is measured in the following manner. Specifically, a patch is placed on the drum surface, on which a measuring terminal is placed. A 216-gram weight is loaded on this measuring terminal, and the drum in this state is sled in a load direction and a perpendicular direction to measure a force acting on the measuring terminal in the drum sliding direction, thereby calculating the dynamic friction coefficient. As the measuring terminal, Load cell WBU10N manufactured by Showa Sokki Corporation is used to measure stress acting in the drum sliding direction.

The embodiments of the invention applied to a color laser printer and a cleaning device provided therein have been described above, but it is needless to say that the invention is also applicable to any other image forming apparatuses including a monochrome printer and a copier and a cleaning device provided therein. The scope of the invention is not limited to this and thus various modifications can be added within a range not departing from the spirits of the invention.

As described above, the cleaning device of the invention may be a device provided in an image forming apparatus including: at least a photosensitive drum; charging means adapted to uniformly charge the photosensitive drum; developing means adapted to develop a latent image formed on the photosensitive drum to visualize it as a toner image; and transfer means adapted to transfer the toner image on the photosensitive drum. Provided in the cleaning device including a cleaning blade making contact with the photosensitive drum and a rotatable magnetic brush roller arranged oppositely to the photosensitive drum can be toner concentration initialization control means adapted to: apply toner consumption bias to the magnetic brush roller to move the toner in a magnetic brush formed on the magnetic brush roller; remove this toner from the photosensitive drum by the cleaning blade; then obtain a toner amount with which toner-to-carrier ratio T/C of the magnetic brush on the magnetic brush roller becomes a predetermined value; supply the obtained amount of toner from the developing means to the photosensitive drum, and apply supply bias to the magnetic brush roller to supply to the magnetic brush roller the toner supplied to the photosensitive drum. All the toner on the magnetic brush formed on the magnetic brush roller is temporarily removed by being moved onto the photosensitive drum, the toner is supplied from the developing means onto the photosensitive drum so that the toner-to-carrier ratio T/C of the magnetic brush on the magnetic brush roller becomes the adequate value, and the toner supplied to the photosensitive drum is supplied to the magnetic brush roller, which permits the toner-to-carrier ratio T/C of the magnetic brush on the magnetic brush roller to be kept at the adequate value. Moreover, even with a photosensitive drum of a small diameter, high effect of rubbing a surface thereof can be maintained over a long period of time. Moreover, an adhesive substance can effectively be removed from the surface of the photosensitive drum. Moreover, an increase in driving torque of the photosensitive drum can be suppressed to prevent ununiform rotation of the photosensitive drum, and occurrence of image failure such as a jitter image attributable to the ununiform rotation can be prevented to stably provide a high-quality image.

The cleaning device described above may be configured such that the application of the supply bias to the magnetic brush roller is performed during at least one rotation of the magnetic brush roller. All the toner held on the magnetic brush can be moved onto the photosensitive drum.

The cleaning device described above may be configured such that the toner concentration initialization control performed by the toner concentration initialization control means is achieved with the frequency in accordance with the image condition and the environment at the times other than the time of image formation. The toner concentration initialization control does not influence the normal image formation operation. Moreover, since the toner concentration initialization control is performed with the frequency in accordance with the image condition and the environment, increasing the frequency with which the toner concentration initialization control is performed in the high temperature/high humidity environment (H/H environment) where the adhesive substance on the photosensitive drum is absorbed and the problem such as the image deletion is likely to occur can improve the rubbing performance on the surface of the photosensitive drum by the magnetic brush roller, which can effectively prevent the occurrence of the image failure.

As described above, the cleaning device of the invention may be a device provided in an image forming apparatus including: at least a photosensitive drum; charging means adapted to uniformly charge the photosensitive drum; developing means adapted to develop a latent image formed on the photosensitive drum to visualize it as a toner image; and transfer means adapted to transfer the toner image on the photosensitive drum. Provided in the cleaning device which includes a cleaning blade making contact with the photosensitive drum and a rotatable magnetic brush roller arranged oppositely to the photosensitive drum and which applies bias to the magnetic brush roller to move the toner on the magnetic brush roller to the photosensitive drum can be T/C control means adapted to: detect a current flowing into the magnetic brush roller upon the application of the bias to the magnetic brush roller; and keep toner-to-carrier ratio T/C of a magnetic brush on the magnetic brush roller constant by supplying the toner from the developing means to the magnetic brush roller through the surface of the photosensitive drum when the detected current is equal to or larger than a first threshold value and by discharging the toner from the magnetic brush roller to the photosensitive drum when the detected current is smaller than a second threshold value smaller than the first threshold value. The T/C of the magnetic brush is controlled by supplying or discharging the toner to or from the magnetic brush roller by the current flowing into the magnetic brush roller upon the application of the bias to the magnetic brush roller, whereby the T/C is set at a value with which a dynamic friction coefficient of the photosensitive drum is kept within a range equal to or smaller than a value with which image deletion does not occur. Therefore, even with a photosensitive drum of a small diameter, image failure such as the image deletion can be prevented and also high effect of rubbing the surface of the photosensitive drum can be maintained over a long period of time to thereby effectively remove an adhesive substance from the surface of the photosensitive drum.

The image forming apparatus of the invention can include the cleaning device described above. The occurrence of the image failure such as the jitter image attributable to the ununiform rotation can be prevented to stably provide a high-quality image.

What is claimed is:

1. A cleaning device comprising:

a magnetic brush roller rubbing a surface of a photosensitive drum by a magnetic brush formed of a toner and carriers;

a cleaning blade removing the toner remaining on the photosensitive drum; and a toner concentration initialization control part, in order that a toner-to-carrier ratio T/C of the magnetic brush formed on the magnetic brush roller falls within a predetermined range, controlling a bias applied to the magnetic brush roller and an amount of the toner supplied from a developing part to the photosensitive drum, wherein the toner concentration initialization control part:

applies a consumption bias to the magnetic brush roller to move to the photosensitive drum all the toner in the magnetic brush; and removes all the toner from the photosensitive drum by the cleaning blade, and then obtains an amount of toner with which the toner-to-carrier ratio T/C of the magnetic brush falls within the predetermined range, supplies the obtained amount of toner from the developing part to the photosensitive drum, and applies a supply bias to the magnetic brush roller to supply, to the magnetic brush roller, the toner supplied to the photosensitive drum.

2. The cleaning device according to claim 1, wherein the application of the supply bias to the magnetic brush roller is performed during at least one rotation of the magnetic brush roller.

3. The cleaning device according to claim 1, wherein the toner concentration initialization control part performs control of the bias applied to the magnetic brush and the amount of the toner supplied to the photosensitive drum with a frequency in accordance with an image condition and the environment at times other than a time of image formation.

4. The cleaning device according to claim 3, wherein the toner concentration initialization control part increases the frequency of the control of the bias applied to the magnetic brush and the amount of the toner supplied from the developing part to the photosensitive drum in accordance with a temperature increase.

5. The cleaning device according to claim 3, wherein the toner concentration initialization control part increases the frequency of the control of the bias applied to the magnetic brush and the amount of the toner supplied from the developing part to the photosensitive drum in accordance with a humidity increase.

6. The cleaning device according to claim 1, wherein the toner concentration initialization control part, in order that the toner-to-carrier ratio T/C of the magnetic brush falls within a range of 10 to 17%, controls the bias applied to the magnetic brush and the amount of the toner supplied from the developing part to the photosensitive drum.

7. An image forming apparatus including the cleaning device according to claim 1.

* * * * *